US007791555B2

(12) United States Patent
Nilsson

(10) Patent No.: US 7,791,555 B2
(45) Date of Patent: Sep. 7, 2010

(54) HIGH GAIN MULTIPLE POLARIZATION ANTENNA ASSEMBLY

(75) Inventor: Jack Nilsson, Medina, OH (US)

(73) Assignee: MP Antenna, North Ridgeville, OH (US)

( * ) Notice: Subject to any disclaimer, the term of this patent is extended or adjusted under 35 U.S.C. 154(b) by 188 days.

(21) Appl. No.: 12/127,741

(22) Filed: May 27, 2008

(65) Prior Publication Data

US 2009/0295642 A1 Dec. 3, 2009

(51) Int. Cl.
*H01Q 9/28* (2006.01)

(52) U.S. Cl. ..... 343/808; 343/773

(58) Field of Classification Search ..... 343/773, 343/774, 808, 846
See application file for complete search history.

(56) References Cited

U.S. PATENT DOCUMENTS 6,346,920 B2 * 2/2002 Sharp et al. ..... 343/773
6,396,456 B1 5/2002 Chiang et al.
6,486,849 B2 11/2002 Buckles
6,693,600 B1 2/2004 Elliot
7,362,283 B2 4/2008 Quintero Illera et al.
7,397,431 B2 7/2008 Baliarda et al.
2004/0164917 A1 8/2004 Nilsson
2004/0164918 A1 8/2004 Nilsson
2004/0164920 A1 8/2004 Nilsson
2007/0069964 A1 * 3/2007 Hoshiai et al. ..... 343/713
2007/0194992 A1 8/2007 Puente Baliarda et al.
2007/0279289 A1 12/2007 Baliarda et al.

FOREIGN PATENT DOCUMENTS

JP 1-105603 A 4/1989

* cited by examiner

*Primary Examiner*—Hoang V Nguyen
(74) *Attorney, Agent, or Firm*—Tarolli, Sundheim, Covell & Tummino LLP

(57) ABSTRACT

An antenna assembly is provided for receiving and transmitting radio frequency signals in a range around a characteristic wavelength. A first radiative element, has a first end and a second end and is made from an electrically conductive material. The first end of the first radiative element is electrically connected to an antenna feed at an apex point and at least a portion of the first radiative element is disposed outwardly away from the apex point at an acute angle relative to, and on a first side of, an imaginary plane intersecting the apex point. A second radiative element has a first end and a second end and is comprised of an electrically conductive material. The first end of the first radiative element is electrically connected to the antenna feed and the first radiative element at the apex point. At least a portion of the second radiative element extends in a direction substantially perpendicular to the imaginary plane. The antenna assembly further includes an electrically conductive ground reference.

14 Claims, 3 Drawing Sheets

HIGH GAIN MULTIPLE POLARIZATION ANTENNA ASSEMBLY

RELATED APPLICATIONS

This application claims priority from U.S. application Ser. No. 11/279,941, filed Apr. 17, 2006 and published as U.S. Published Patent Application No. 2007/0132651 which is a divisional of patent application Ser. No. 10/786,656, filed on Feb. 25, 2004, now U.S. Pat. No. 7,030,831, issued Apr. 18, 2006, which was a continuation-in-part of patent application Ser. No. 10/294,420 filed on Nov. 14, 2002, now U.S. Pat. No. 6,806,841 which issued on Oct. 19, 2004. Each of these documents are incorporated herein by reference in their entirety.

Further the subject matter of each of U.S. Pat. No. 7,348,933, issued Mar. 25, 2008, U.S. Pat. No. 7,236,129, issued Jun. 26, 2007, U.S. Pat. No. 7,138,956, issued Nov. 21, 2006, and U.S. Pat. No. 6,496,152, issued Dec. 17, 2002, is incorporated herein by reference.

TECHNICAL FIELD

Certain embodiments of the present invention relate to antennas for wireless communications. More particularly, certain embodiments of the present invention relate to an apparatus and method providing a multi-polarized omni-directional or beam antenna exhibiting substantial spatial diversity for use in point-to-point and point-to-multipoint communication applications for the Internet, land, maritime, aviation, and space.

BACKGROUND OF THE INVENTION

For years, wireless communications have struggled with limitations of audio/video/data transport and internet connectivity in both obstructed (indoor/outdoor) and line-of-site (LOS) deployments. A focus on antenna gain as well as circuitry solutions have proven to have significant limitations. Unresolved, non-optimized (leading edge) technologies have often given way to "bleeding edge" attempted resolutions. Unfortunately, all have fallen short of desirable goals.

While lower frequency radio waves benefit from an 'earth hugging' propagation advantage, higher frequencies do inherently benefit from (multi-) reflection/penetrating characteristics. However, with topographical changes (hills & valleys) and object obstructions (e.g., natural such as trees, and man-made such as buildings/walls) and with the resultant reflections, diffractions, refractions and scattering, maximum signal received may well be off-axis (non-direct path) and multi-path (partial) cancellation of signals results in null/weaker spots. Also, some antennas may benefit from having gain at one elevation angle ('capturing' signals of some pathways), while other antennas have greater gain at another elevation angle, each type being insufficient where the other does well. In addition, the radio wave can experience altered polarizations as they propagate, reflect, refract, diffract, and scatter. A very preferred (polarization) path may exist; however, insufficient capture of the signal can result if this preferred path is not utilized and non-utilization of polarization-diverse weaker multipath signals, which statistically are not entirely out of phase also leads to lesser signal stability.

BRIEF SUMMARY OF THE INVENTION

In accordance with an aspect of the invention, an antenna assembly is provided for receiving and transmitting radio frequency signals in a range around a characteristic wavelength. A first radiative element, has a first end and a second end and is made from an electrically conductive material. The first end of the first radiative element is electrically connected to an antenna feed at an apex point and at least a portion of the first radiative element is disposed outwardly away from the apex point at an acute angle relative to, and on a first side of, an imaginary plane intersecting the apex point. A second radiative element has a first end and a second end and is comprised of an electrically conductive material. The first end of the second radiative element is electrically connected to the antenna feed and the first radiative element at the apex point. At least a portion of the second radiative element extends in a direction substantially perpendicular to the imaginary plane. The assembly further comprises an electrically conductive ground reference.

In accordance with another aspect of the invention, a directional antenna assembly is provided. The directional antenna assembly includes a conductive base member and three intermediate members joined to the conductive base member at substantially right angles and extending on a first side of a plane defined by the conductive base member. Two side intermediate members are joined to opposing edges of a center intermediate member with each side intermediate member joined to the center intermediate member at an obtuse angle. Three apex members are each joined to an edge of one of the intermediate members at an obtuse angle relative to the intermediate member. The three apex members extend away from the plane defined by the base member and meet at a common point. An antenna assembly is mounted to the conductive base member as to provide significant capacitive coupling between at least one radiative element associated with the antenna assembly and the conductive base member.

In accordance with yet another aspect of the present invention, an antenna assembly is provided for receiving and transmitting radio frequency signals in a range around a characteristic wavelength. A plurality of radiative element, each have a first end and a second end and are comprised of an electrically conductive material. The first end of each radiative element is electrically connected to an antenna feed at an apex point such that each radiative element extends away from the apex on a first side of, an imaginary plane intersecting the apex point. Each radiative element includes a first segment extending outwardly away from the apex point at an acute angle relative to the imaginary plane, a second segment extending from the first segment in a direction that is substantially parallel to the imaginary plane, such that an angle formed by the first segment and the second segment is acute, and a third segment extending from the second segment in a direction that is substantially perpendicular to the imaginary plane, such that the angle between the second segment and the third segment is approximately ninety degrees. The assembly further comprises an electrically conductive ground reference.

DETAILED DESCRIPTION OF THE INVENTION

Figure 1:
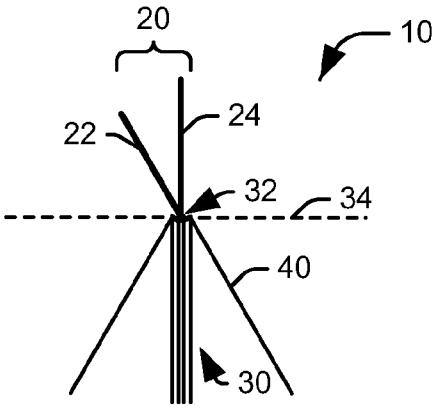
FIG. 1 illustrates a high-gain, multi-polarized antenna for transmitting and receiving radio frequency signals around a characteristic wavelength, in accordance with various aspects of the present invention.

Generally stated, a novel three-dimensionally constructed antenna with in-built spatial diversity (one part perhaps in a "null spot," while another part of the antenna in a: "hot spot"), relatively broad signal patterning, and in-built polarization diversity serves to stabilize signal and throughput (minimizing Ethernet rejects and the like) in the real "obstructed," often dynamic world. FIG. 1 illustrates a first embodiment of a high-gain, multi-polarized antenna 10 for transmitting and receiving radio frequency signals around a characteristic wavelength, in accordance with various aspects of the present invention. It will be appreciated that the term "radio frequency," is intended to encompass frequencies within the microwave and traditional radio bands, specifically frequencies between 3 Hz and 3 THz. The antenna comprises a multi-polarized driven assembly 20 that includes at least a first radiative element 22 and a second radiative element 24, each formed from a conductive material. The two radiative elements 22 and 24 of the driven element 20 have respective first ends are electrically connected to one another and an antenna feed 30 at an apex point 32 such that the radiative elements 22 and 24 each extend to respective second ends that are distant from the apex point. The radiative elements 22 and 24 are all located to a first side of an imaginary plane 34. It will be appreciated that additional radiative elements (not shown) can be utilized in the driven element in accordance with various implementations of the invention.

Electromagnetic waves are often reflected, diffracted, refracted, and scattered by surrounding objects, both natural and man-made. As a result, electromagnetic waves that are approaching a receiving antenna can be arriving from multiple angles and have multiple polarizations and signal levels. The antenna 10 illustrated in FIG. 1 is configured to capture or utilize the preferred approaching signal whether the preferred signal is a line-of-sight (LOS) signal or a reflected signal, and no matter how the signal is polarized. In the illustrated antenna 10, the multiple radiative members 22 and 24 are positioned over a ground plane and properly spaced to allow signals of diverse polarizations to generated and/or received in various different directions. Therefore, such a driven element is said to be "multi-polarized" as well as providing "geometric spatial capture of signal". If a driven element produced all polarizations in all planes (e.g., all planes in an x, y, z coordinate system) and the receiving antenna is capable of capturing all polarizations in all planes, then the significantly greatest preferred polarization path, that is the signal path allowing for maximum signal amplitude, may be utilized, as well as a variety of polarization diverse and spatially diverse resultant signals.

A conductive ground plane structure 40 can be located at the imaginary plane or on a second side of the imaginary plane 34. The ground plane structure 40 is illustrated herein as a conical member, but it will be appreciated that the ground plane structure can be configured in any of a number of ways. For example, a planar or cylindrical ground plane can be utilized. Further, the ground plane structure 40 does not need to be a single, solid structure. For example, the ground plane can be implemented as a conductive mesh or comprise a number of discrete conductive elements evenly spaced around the apex point 32. The antenna feed 30 can comprise an electrical connector, such as a coaxial connector which comprising a center conductor, an insulating dielectric region, and an outer conductor. The electrical connector serves to mechanically connect the radiative elements 22 and 24 to the ground plane structure 40 and to allow electrical connection of the radiative elements 22 and 24 and the ground plane structure 40 to a transmission line for interfacing to a radio frequency (RF) transmitter and/or receiver. For example, the center conductor electrically connects to the apex point 32 of the radiative elements 22 and 24 and the outer conductor electrically connects to the ground plane. An insulating dielectric (not shown) can be utilized to electrically isolate the center conductor, and therefore the radiative elements 22 and 24 from the outer conductor and the ground plane structure 40. The insulating dielectric region may also serve to mechanically affix the radiative elements 22 and 24 to the ground plane structure 40.

In accordance with an embodiment of the present invention, at least a portion of the first radiative element 22 extends outwardly from the apex point at an acute angle, that is, an angle less than ninety degrees, relative to the imaginary plane 34. At least a portion of the second radiative element 24 extends in a direction substantially perpendicular to the imaginary plane 34. By vertically extending at least one of the radiative elements in this manner, it is possible to enhance the gain of the antenna assembly 10 while maintaining the polarization diversity of the antenna.

Figure 2:
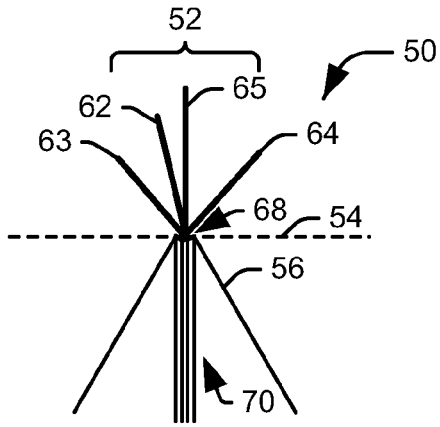
FIG. 2 illustrates a side view of a first exemplary implementation of an antenna assembly in accordance with an aspect of the present invention.

FIG. 2 illustrates a side view of a first exemplary implementation of an antenna assembly 50 in accordance with an aspect of the present invention. The illustrated antenna assembly 50 comprises a driven antenna assembly 52 located on a first side of an imaginary plane 54, and a ground reference 56 located at the imaginary plane or on a second side of the imaginary plane. In the illustrated implementation, the ground reference 56 is illustrated as conical, but it will be appreciated that other configurations of the ground plane can be utilized within the illustrated antenna assembly. The ground reference 56 may be comprised of any good electrically conductive material such as, for example, copper or stainless steel. The ground reference 56 may be at an angle to zero degree to ninety degree relative to the imaginary plane. In accordance with an aspect of the present invention, a given side of the conical ground plane, viewed in cross section, forms an angle between forty-five and seventy degrees with the imaginary plane 54 for greater gain at the imaginary plane and still greater signal well below the imaginary plane. In the illustrated implementation, the side of the cone forms a sixty degree angle with the imaginary plane, and a thirty degree angle with the axis. The length of the ground reference 56 is at least one-quarter of a wavelength of a tuned radio frequency of operation.

The surface of the ground reference 56 may be continuous or may be a crosshatched wired mesh, in accordance with various embodiments of the present invention. Also, a three or more linear elements disposed in a substantially conical shape may form the ground reference, in accordance with an embodiment of the present invention. In other implementations, the ground reference 56 can include a cylindrical sleeve having a closed upper base side, or the shield of the a coaxial associated with the antenna feed can serve as the ground reference, although various styles of stubs, sleeves, matching systems, baluns, transformers, etc. may also be used.

The driven antenna assembly 52 comprises four radiative elements 62-65 that radiate out from a common apex 68. The driven antenna assembly 52, and its constituent elements

62-65, are formed from a conductive material. The radiative elements 62-65 are electrically connected to an antenna feed 70 and one another at the apex 68. The radiative elements comprise first, second, and third radiative elements 62-64 that are generally linear and extend away from the apex 68 at an acute angle relative to the imaginary plane 54. Each of the first, second, and third radiative antenna element 62-64 may be at a unique acute angle or at the same acute angle relative to the imaginary plane 54. In the illustrated implementation, the first, second, and third radiative elements 62-64 are spaced and oriented such that the first, second, and third elements are spaced evenly, that is, at intervals of one-hundred and twenty degrees. In a further embodiment of this invention, the first, second and third radiative antenna elements 62-64 can comprise wound conductive coils. The use of wound conductive coils allows an antenna of substantially smaller size to be manufactured.

In accordance with other embodiments of the present invention, the set of elements represented by the first, second, and third radiative elements 62-64 can be generalized to only two or greater than three elements having similar length and orientation. For example, in place of the first, second, and third radiative elements 62-64, four radiative elements, circumferentially spaced at intervals of ninety degrees, or otherwise, may be used. In fact, a large number of radiative members may be effectively replaced with a continuous surface of a cone, a pyramid, or some other continuous shape that is spatially diverse on one side (e.g., has significant spatial extent) and comes substantially to a point (e.g., an apex) on the other side. For example, in accordance with an embodiment of the present invention, a linear radiative member connected at one end to a radiative loop having a certain spatial extend may be used. Greater relative polarization diversity in the real world is seen with varied relative lengths of elements 62-64.

In accordance with an embodiment of the present invention, the antenna 50 is designed to operate at a radio frequency of approximately 2.4 GHz. The lengths of the radiative elements are cut to appropriate lengths to be produce an antenna assembly tuned to a frequency of 2.4 GHz, specifically a wavelength of approximately 12.5 cm. The antenna feed 70 of FIG. 2 can include an SMA (or similar) coaxial connector and a transmitter/receiver circuit board (not shown). The SMA connector and board can be electrically connected together by a length of coaxial cable. The SMA connector allows a center conductor of the coaxial cable to electrically connect to the radiative elements 62-65 and allows a ground braid of the coaxial cable to electrically connect to the ground reference 56. A dielectric material electrically insulates the center conductor and the radiative elements 62-65 from the ground reference 56.

In accordance with an aspect of the present invention, a fourth radiative element 65 can be utilized to provide increased gain to the antenna 50 via vertical pattern compression. The fourth radiative element 65 can be electrically connected to the first, second, and third radiative elements 62-64 and the antenna feed 70 at the apex, and extend substantially perpendicularly from the apex. In accordance with an aspect of the present invention, the fourth radiative element 65 can be longer than each of the first, second, and third radiative elements 62-64. In one implementation, the fourth radiative element 66 has a length approximately seven percent longer than the longest of the first, second, and third radiative elements 62-64. Accordingly, the illustrated antenna provides a superior gain while preserving the spatial and polarization diversity of the antenna.

Figure 3:
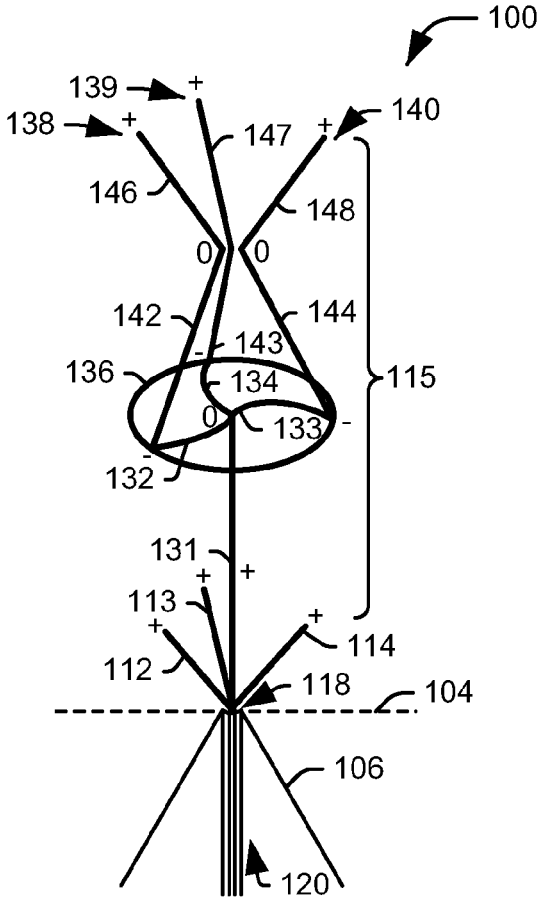
FIG. 3 illustrates a side view of a second exemplary implementation of an antenna assembly in accordance with an aspect of the present invention.

FIG. 3 illustrates a side view of a second exemplary implementation of an antenna assembly 100 in accordance with an aspect of the present invention. The illustrated antenna assembly 100 comprises a driven antenna assembly 102 located on a first side of an imaginary plane 104, and a ground reference 106 located at the imaginary plane or on a second side of the imaginary plane. In the illustrated implementation, the ground reference 106 is illustrated as conical, but it will be appreciated that other configurations of the ground plane can be utilized within the illustrated antenna assembly. The ground reference 106 may be comprised of any good electrically conductive material such as, for example, copper or stainless steel. The ground reference 106 may be at any angle of zero degrees to ninety degrees relative to the imaginary plane. In accordance with an aspect of the present invention, a given side of the conical ground plane, viewed in cross section, forms an angle between forty-five and seventy degrees with the imaginary plane 104 of the cone. In the illustrated implementation, the side of the cone forms a thirty degree angle with the axis, and a sixty degree angle with the imaginary plane 104. The length of the ground reference 106 is at least one-quarter of a wavelength of a tuned radio frequency of operation.

The surface of the ground reference 106 may be continuous or may be a crosshatched wired mesh, in accordance with various embodiments of the present invention. Also, a three or more linear elements disposed in a substantially conical shape may form the ground reference, in accordance with an embodiment of the present invention. In other implementations, the ground reference 106 can include a cylindrical sleeve having a closed upper base side, or the shield of the a coaxial associated with the antenna feed can serve as the ground reference, although various styles of stubs, sleeves, matching systems, baluns, transformers, etc. may also be used.

The driven antenna assembly 102 comprises four radiative elements 112-115 that radiate out from a common apex 118. The driven antenna assembly 102, and its constituent elements 112-115, are formed from a conductive material. The radiative elements 112-115 are electrically connected to an antenna feed 120 and one another at the apex 118. The radiative elements comprise first, second, and third radiative elements 112-114 that are generally linear and extend away from the apex 118 at an acute angle relative to the imaginary plane 104. Each of the first, second, and third radiative antenna element 112-114 may be at a unique acute angle or at the same acute angle relative to the imaginary plane 104. While the radiative antenna elements 112-114 can extend at any acute angle, in most implementations, an angle between forty-five and seventy degree relative to the imaginary plane 104 is desirable. In the illustrated implementation, the radiative antenna elements extend at an angle of sixty degrees relative to the imaginary plane. In the illustrated implementation, the first, second, and third radiative elements 112-114 are spaced and oriented such that the first, second, and third elements are spaced evenly, that is, at intervals of one-hundred and twenty degrees. In a further embodiment of this invention, the first, second and third radiative antenna elements 112-115 can comprise wound conductive coils. The use of wound conductive coils allows an antenna of substantially smaller size to be manufactured.

In accordance with other embodiments of the present invention, the set of elements represented by the first, second, and third radiative elements 112-114 can be generalized to only two or greater than three elements having similar length and orientation. For example, in place of the first, second, and third radiative elements 112-114, four radiative elements, circumferentially spaced at intervals of ninety degrees, or otherwise, may be used. In fact, a large number of radiative members may be effectively replaced with a continuous surface of a cone, a pyramid, or some other continuous shape that is spatially diverse on one side (e.g., has significant spatial extent) and comes substantially to a point (e.g., an apex) on the other side. For example, in accordance with an embodiment of the present invention, a linear radiative member connected at one end to a radiative loop having a certain spatial extend may be used.

In accordance with an embodiment of the present invention, the antenna 100 is designed to operate at a radio frequency of approximately 2.4 GHz. The lengths of the radiative elements are selected to tune the antenna to a frequency of 2.4 GHz. The antenna feed 120 of FIG. 3 can include an SMA (or similar) coaxial connector and a transmitter/receiver circuit board (not shown). The SMA connector and board can be electrically connected together by a length of coaxial cable. The SMA connector allows a center conductor of the coaxial cable to electrically connect to the radiative elements 112-115 and allows a ground braid of the coaxial cable to electrically connect to the ground reference 106. A dielectric material electrically insulates the center conductor and the radiative elements 112-115 from the ground reference 106.

In accordance with an aspect of the present invention, a fourth radiative element 115 can be utilized to provide increased gain to the antenna 100 by effectively "stacking" a second radiative assembly collinearly with the first, second, and third radiative elements 112-114. The fourth radiative element 115 can be electrically connected to the first, second, and third radiative elements 112-114 and the antenna feed 120 at a first end of the fourth radiative element, so no power divider assembly is necessary to realize the improvement in gain.

In the illustrated example, the fourth radiative element 115 can include a first segment 131 that extends from the axis in a direction substantially perpendicular to the imaginary plane. The first segment 131 can extend for approximately one-half of the characteristic wavelength. A plurality of curvilinear elements 132-134 extend in a direction parallel to the imaginary plane from a second end of the first segment to a closed polygonal element 136. The closed polygonal element 136 is substantially circular in the illustrated implementation, but it will be appreciated that the closed polygonal element can be configured to assume any appropriate closed shape, and the shape of the polygonal element can vary according to the number of curvilinear elements 132-134. In the illustrated implementation, the curvilinear elements 132-134 are curved slightly with a single point of concavity, but it will be appreciated that linear elements, elements having a larger degree of curvature, or elements having multiple points of concavity can be utilized. Each of the curvilinear elements 132-134 can have a length of approximately one-quarter of a wavelength, and the respective second ends of the plurality of curvilinear elements can be spaced evenly around the closed polygonal element 136.

At each point of intersection between the plurality of curvilinear elements 132-134 and the closed polygonal element 136, one of a plurality of angular radiative elements 138-140 can extend upwards from the closed polygonal element. The plurality of angular radiative elements 138-140 can include respective first segments 142-144 that extend upward from the closed polygonal element 136 toward a center point of the closed polygonal element to terminate near the center point of the closed polygonal element. Respective second elements 146-148 of the plurality of angular radiative elements 138-140 can extend upward from the ends of the first segments of the plurality of angular radiative elements 138-140 outwardly away from center point of the closed polygonal element, such that an angle between the first segments and the second segments is either right or obtuse. In most implementations, an angle of ninety to one hundred twenty degrees between the first segments and the second segments is desirable, and in the illustrated implementation, the angle is one-hundred twenty degrees. Each of the first 142-144 and second 146-148 plurality of elements comprising the plurality of angular radiative elements 138-140 can be approximately one-quarter of the characteristic wavelength in length and the plurality of angular radiative elements can be spaced evenly around the closed polygonal element 136.

When a sinusoidal voltage signal is fed into the antenna 100 (e.g., via a transmission line), alternating electric charge is formed on the radiative antenna elements 112-115 and the ground reference 106. FIG. 3 represents the state of the antenna at a particular moment in time. The "+" symbols in FIG. 3 represent positive charge corresponding to the positive peaks of the sinusoidal signal, the "−" symbols represent negative charge corresponding to the negative peaks of the sinusoidal signal, and the "0" symbols represent the zero crossing points of the sinusoidal signal feeding the antenna 100. The "+", "−", and "0" charges are separated across the ground reference by one-quarter of the characteristic wavelength as would be expected based on a sinusoidal waveform. Radiated electric fields will be generated between each "+" and its neighboring "−"'s, and the negative charge reflected in the ground reference 106. For example, electrical fields are generated between the positive charges at the end of each of the angular radiative elements 138-140 and the negative charges located around the closed polygonal element 136. These electrical fields propagate outward from the antenna 100 in a direction perpendicular to the generated electric field. There is also a corresponding magnetic field associated with the electric field to form a complete, radiating electromagnetic wave. It will thus be appreciated that the illustrated antenna 100 provides a radiation pattern having varying polarizations and ending in various directions, maximizing the likelihood that the antenna can communication with devices in any of a variety of positions and orientations.

Figure 4:
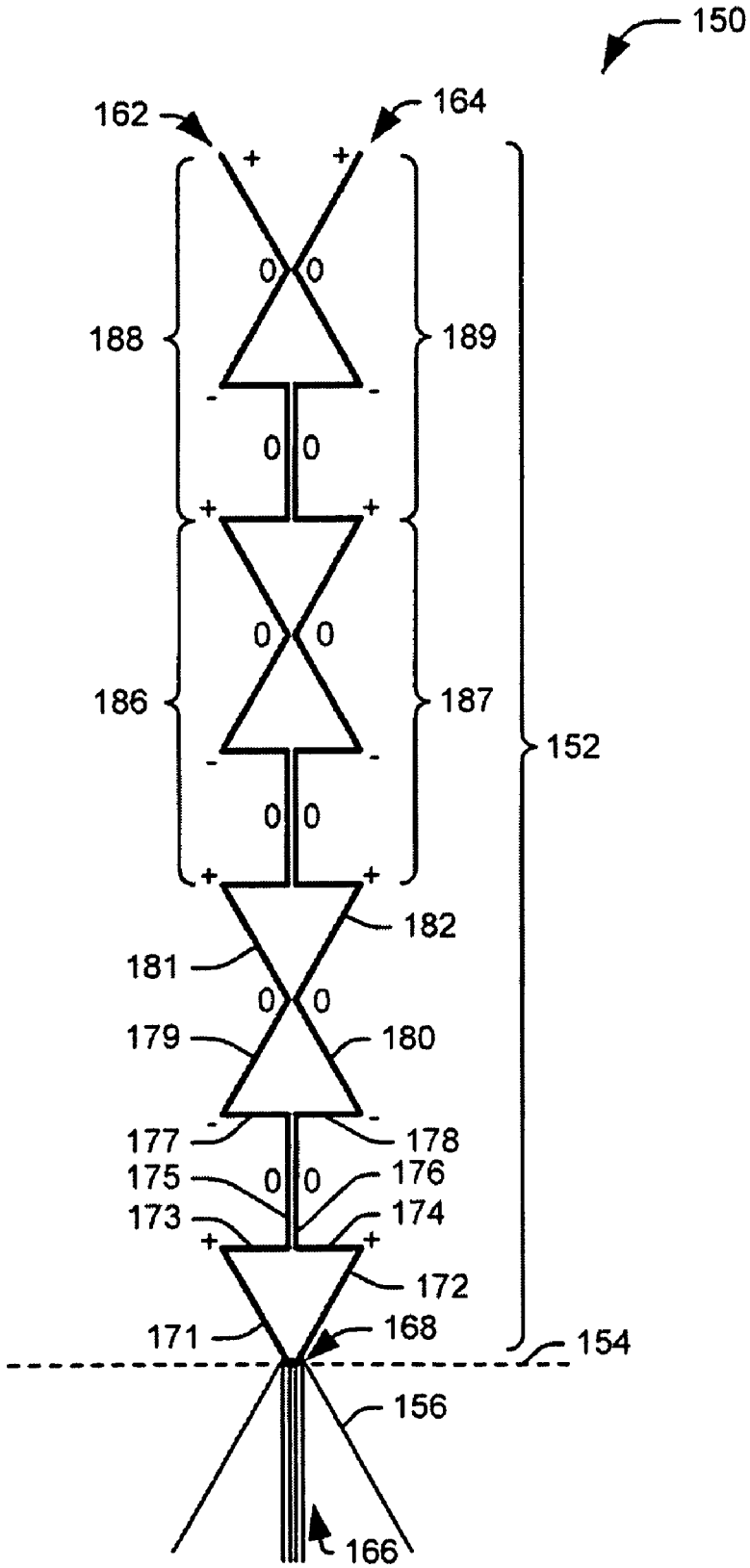
FIG. 4 illustrates a side view of a third exemplary implementation of an antenna assembly in accordance with an aspect of the present invention.

FIG. 4 illustrates a side view of a third exemplary implementation of an antenna assembly 150 in accordance with an aspect of the present invention. The illustrated antenna assembly 150 comprises a driven antenna assembly 152 located on a first side of an imaginary plane 154, and a ground reference 156 located at the imaginary plane or on a second side of the imaginary plane. In the illustrated implementation, the ground reference 156 is illustrated as conical, but it will be appreciated that other configurations of the ground plane can be utilized within the illustrated antenna assembly. The ground reference 156 may be comprised of any good electrically conductive material such as, for example, copper or stainless steel. In accordance with an aspect of the present invention, a given side of the conical ground plane, viewed in cross section, forms an angle between forty-five and seventy degrees with the imaginary plane 154. In the illustrated implementation, the side of the cone forms a thirty degree angle with the axis, and a sixty degree angle with the imaginary plane 154. The length of the ground reference 156 is at least one-quarter of a wavelength of a tuned radio frequency of operation.

The surface of the ground reference 156 may be continuous or may be a crosshatched wired mesh, in accordance with various embodiments of the present invention. Also, a three or more linear elements disposed in a substantially conical shape may form the ground reference, in accordance with an embodiment of the present invention. In other implementations, the ground reference 156 can include a flat plane or a cylindrical sleeve having a closed upper base side, or the shield of the a coaxial associated with the antenna feed can serve as the ground reference, although various styles of stubs, sleeves, matching systems, baluns, transformers, etc. may also be used.

The driven antenna assembly includes a plurality of radiative elements 162 and 164 that are formed from a conductive material. The plurality of radiative elements 162 and 164 are electrically connected to one another and an antenna feed 166 at a common apex point 168. The antenna feed 166 can include an SMA (or similar) coaxial connector and a transmitter/receiver circuit board (not shown). The SMA connector and board can be electrically connected together by a length of coaxial cable. The SMA connector allows a center conductor of the coaxial cable to electrically connect to the radiative elements 162 and 164 and allows a ground braid of the coaxial cable to electrically connect to the ground reference 156. A dielectric material electrically insulates the center conductor and the radiative elements 162 and 164 from the ground reference 156.

In accordance with an aspect of the present invention, the illustrated driven antenna assembly 152 is configured to provide increased gain to the antenna 150 by effectively "stacking" multiple spatial and polarization diverse antenna assemblies collinearly. By incorporating these structures into a single driven assembly 152, the use of a power divider can be avoided, significantly decreasing the expense of the antenna 150, while still providing a high-gain, spatial and polarization diverse antenna. The driven antenna assembly 152 is illustrated as comprising two radiative elements 162 and 164 for ease of illustration. It will be appreciated, however, that the driven antenna assembly 162 can comprise one radiative element or more than two radiative elements, depending on the implementation. In one implementation, three radiative elements are evenly spaced around the apex 168 and mirror one another along their length around the apex, such that when a portion of one radiative element 162 extends toward the center of the driven assembly 152, defined here a line, normal to the imaginary plane 154, that extends from the apex 168 to the first side of the imaginary place, the portions of the other radiative elements 164 at the same height above the apex also extend toward the center of the driven assembly.

The plurality of radiative elements 162 and 164 comprise respective first linear segments 171 and 172 that extend outwardly from the apex 168 at an acute angle relative to the imaginary plane. The first linear segments can extend at any acute angle, but in most implementations, an angle between forty-five and seventy degrees relative to the ground plane 154 is desirable. In the illustrated implementation, the first linear segments 171 and 172 extend at an angle of sixty degrees relative to the imaginary plane. Respective second linear segments 173 and 174 are connected at respective first ends to an end of their corresponding first linear segments and extend toward the center of the driven assembly 152 in a direction that is substantially parallel to the imaginary plane, such that an angle formed by each first linear segment and second linear segment is acute. In one implementation, the angle formed between the first segment 171 and 172 and the second segment 173 and 174 is between twenty and forty-five degrees. In the illustrated implementation, the second linear segments 173 and 174 are approximately one-half the length of their corresponding first linear segments.

Respective third linear segments 175 and 176 are connected at respective first ends to the second ends of their corresponding second linear segments. Each third linear segment extends upward, that is, away from the imaginary plane, from the second linear segment in a direction that is substantially perpendicular to the imaginary plane, such that the angle between the second linear segment and the third linear segment is approximately ninety degrees. In the illustrated implementation, each third linear segment 175 and 176 has a length comparable to the length of its corresponding first linear segment 171 and 172. Respective fourth linear segments 177 and 178 are connected at respective first ends to the second ends of their corresponding third linear segments 175 and 176. The fourth linear segments 177 and 178 extend away from the center of the driven assembly 152 in a direction that is substantially parallel to the imaginary plane, such that an angle formed by each third linear segment and fourth linear segment is substantially equal to ninety degrees. In the illustrated implementation, the fourth linear segments 177 and 178 are approximately one-half the length of their corresponding first linear segments.

Respective fifth linear segments 179 and 180 are connected at respective first ends to second ends of their corresponding fourth linear segments 177 and 178. The fifth linear segments 179 and 180 extend toward the center of the driven assembly at an acute angle relative to the imaginary plane. Like the first linear segments 171 and 172, the fifth linear segments 179 and 180 can extend at any acute angle, but an angle between forty-five and seventy degrees is generally desirable. In the illustrated implementation, the first linear segments 171 and 172 extend at an angle of sixty degrees relative to the imaginary plane, and have a length comparable to that of the first element.

The first linear segments 171 and 172 and the ground plane assembly 156 can be conceptualized as a first antenna assembly; when configured as illustrated, with the first linear segments having a length of approximately one-quarter of a wavelength of a characteristic frequency of the antenna, the antenna 150 would function appropriately without any portion of the radiative antenna elements 162 and 164 above the first linear segments 171 and 172. The second through sixth elements 173-182 of each radiative element 162 and 164 represent, effectively, the addition of another spatially and polarization diverse half-wave dipole on the radiative element. Accordingly, additional gain is realized in much the same manner as an antenna stacking arrangement.

When a sinusoidal voltage signal is fed into the antenna 150 (e.g., via a transmission line), alternating electric charge is formed on the radiative antenna elements 162 and 164 and the ground reference 156. FIG. 4 represents the state of the antenna at a particular moment in time. The "+" symbols in FIG. 4 represent positive charge corresponding to the positive peaks of the sinusoidal signal, the "−" symbols represent negative charge corresponding to the negative peaks of the sinusoidal signal, and the "0" symbols represent the zero crossing points of the sinusoidal signal feeding the antenna 150. The "+", "−", and "0" charges are separated across the ground reference by one-quarter of the characteristic wavelength as would be expected based on a sinusoidal waveform. Radiated electric fields will be generated between each "+" and its neighboring "−"'s, and the negative charge reflected in the ground reference 156. For example, electrical fields are generated between the positive charges at the end of each of the sixth linear segments 181 and 182 and the negative charges located at the ends of the fourth linear segments 177 and 178. These electrical fields propagate outward from the antenna 150 in a direction perpendicular to the generated electric field. There is also a corresponding magnetic field associated with the electric field to form a complete, radiating electromagnetic wave. It will thus be appreciated that the illustrated antenna 150 provides a radiation pattern having varying spatially, polarization, and pattern diverse signals and ending in various directions, maximizing the likelihood that the antenna can communication with devices in any of a variety of positions and orientations.

This basic pattern established by the second, third, fourth, fifth, and sixth linear segments 173-182 can be repeated to further enhance the gain of the antenna. In the illustrated implementation, each of the radiative elements 162 and 164 can include two additional stacked sets of linear segments 186-189 configured in the same manner as the second, third, fourth, fifth, and sixth linear segments 173-182. Accordingly, the illustrated antenna assembly 150 is comparable to four stacked antennas, and in accordance with an aspect of the present invention, provides comparable gain while eliminating the power divider hardware, including the additional ground plane assemblies and antenna feeds that such a configuration would require. It will be appreciated that this configuration is not limited to the simulation of four stacked antenna assemblies, and any number of sets of stacked linear elements can be used for the purposes of a given application.

In accordance with an embodiment of the present invention, the antenna 100 is designed to operate at a radio frequency of approximately 2.4 GHz. The lengths of the various segments comprising the radiative elements are thus selected to be responsive to electromagnetic radiation having frequencies in a range around 2.4 GHz. To this end, each of the third, fifth, and sixth linear elements 175, 176, and 179-182, as well as their counterparts in the additional stacked sets of linear segments 186-189, can have a length of approximately one-quarter of a characteristic wavelength corresponding to a frequency of 2.4 GHz. The lengths of the second and fourth elements 173, 174, 177, and 178 and their counterparts in the additional stacked sets of linear segments 186-189 will vary with the angles at which their adjacent segments extend. In the illustrated implementation, in which the acute angles in the radiative elements 162 and 164 are approximately sixty degrees, the lengths of the second and fourth elements 173, 174, 177, and 178 will be approximately one-eighth of the characteristic wavelength.

Figure 5:
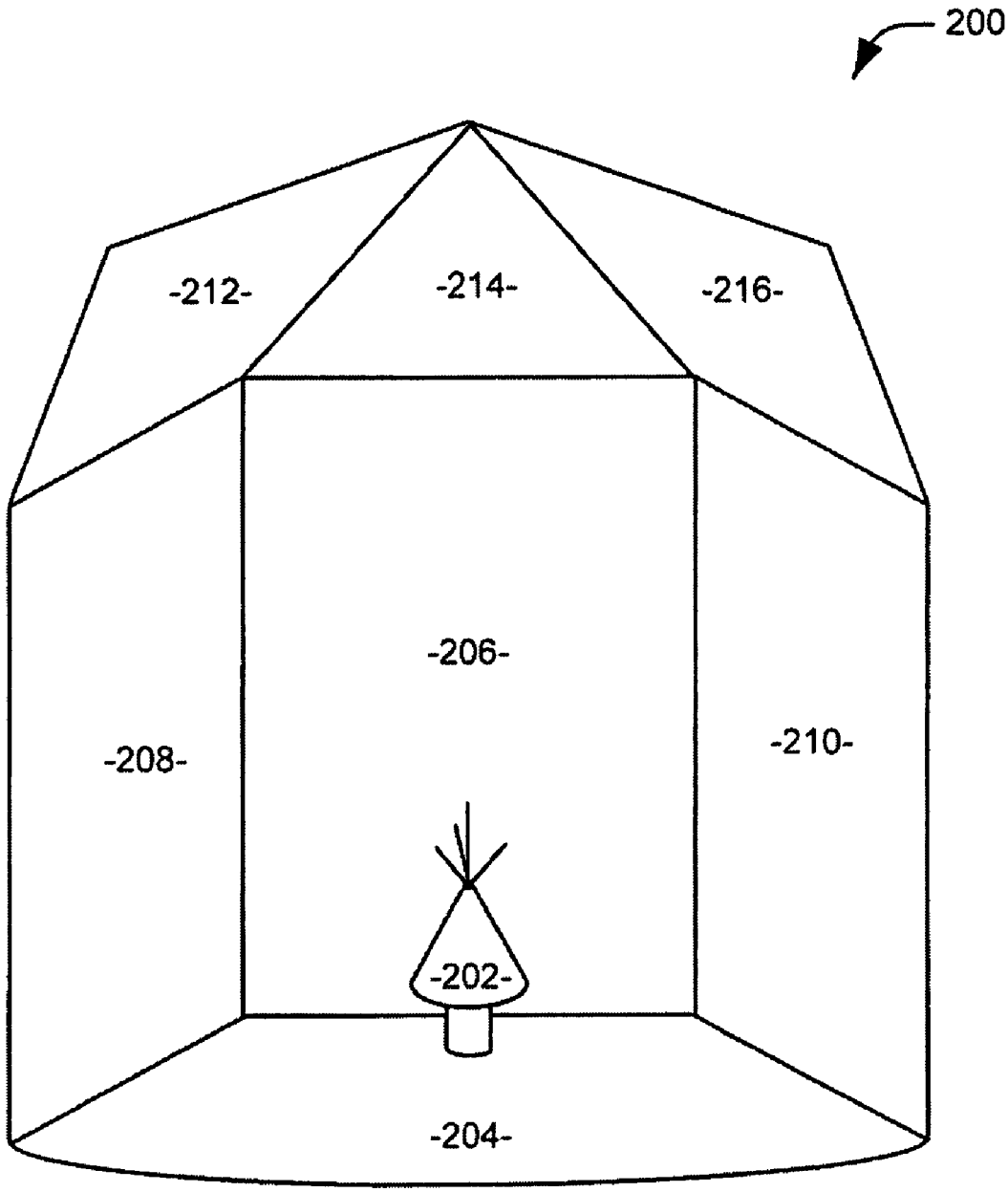
FIG. 5 illustrates a modified trough reflector assembly that is configured to provide improved gain for a multi-polarized antenna assembly in accordance with an aspect of the present invention.

FIG. 5 illustrates a modified trough reflector assembly 200 that is configured to provide improved gain for a multi-polarized antenna assembly 202 in accordance with an aspect of the present invention. For example, the modified trough reflector assembly 200 can be used with an implementation of a high-gain antenna as illustrated herein in FIG. 2. The trough assembly 200 is configured to focus electromagnetic radiation, specifically electromagnetic radiation at or near a characteristic frequency of the antenna assembly 202, incident to the device from a given direction onto the antenna, greatly increasing the gain of the antenna along that direction. Essentially, the modified trough reflector assembly 200 allows the omni-directional multi-polarized antenna assembly 202 to function as a directional antenna at a significantly higher gain. Each of the members 204, 206, 208, 210, 212, 214, 216 comprising the trough reflector assembly 200 can be made from an appropriate conductive material, configured, for example, as solid plating, discrete elements, or a mesh arrangement, to provide substantial interaction with electromagnetic radiation at and around the characteristic frequency. It will be appreciated that the trough reflector assembly 200 can be constructed from individual conductive members or formed as a unitary assembly. Accordingly, the various members 204, 206, 208, 210, 212, 214, 216 do not necessarily represent discrete pieces of material, and the term "joined" is intended to encompass a situation in which the members were formed as a continuous element. It will further be appreciated that the trough reflector assembly 200 can be deployed in any of a number of orientations, depending on the application to which the through reflector assembly is applied. Accordingly, terms such as "base" and "apex" are used solely to indicate the relative positions of members comprising the device and should not be read to imply any particular directionality.

The trough reflector assembly 200 comprises a conductive base member 204 and three substantially rectangular intermediate members 206, 208, and 210 joined at substantially right angles to the base member. Two side intermediate members 208 and 210 are joined to opposing edges of a center intermediate member 206 along respective first edges as to form an obtuse angle with the center intermediate member along the joined edges. In the illustrated implementation, this angle is approximately one-hundred twenty degrees. The three intermediate members 206, 208, and 210 define a concave structure having an opening opposite the center intermediate member 208.

Each of the intermediate members 206, 208, and 210 are joined to respective apex members 212, 214, and 216. Each of the apex members 212, 214, and 216 is joined to one of the intermediate members 206, 208, and 210 along respective first edges at an obtuse angle, such that the apex members 212, 214, and 216 extend from respective edges of the intermediate members away from the plane defined by the base member and toward the opening defined by the three intermediate members. A first side apex member 212 is joined to a center apex member 214 along respective second edges, and a second side apex member 216 is joined to a third edge of the second upper member, such that the three apex members all meet at a common point at their farthest extent toward the opening. In the illustrated implementation, the side apex members 212 and 216 are shaped as quadrilaterals and the center apex member is shaped as an isosceles triangle.

In accordance with an aspect of the present invention, the antenna assembly 202 can be mounted at the base member 204 of the trough reflector assembly 200 such that significant capacitive coupling is experienced between the shield connected elements of the antenna assembly, specifically a conductive ground reference associated with the antenna, and the conductive base member. The antenna assembly 202 can be driven by an antenna feed 220, for example, a coaxial antenna feed, to allow for the transmission and reception of signals by an associate transceiver (not shown).

In accordance with an embodiment of the present invention, the modified trough reflector assembly 200 is designed to operate at a radio frequency of approximately 2.4 GHz. The size of the various members comprising the modified trough reflector assembly are thus selected to be focus electromagnetic radiation having frequencies in a range around 2.4 GHz to the antenna assembly. In accordance with an aspect of the present invention, the base member 204 can be a four sided figure, with two parallel straight edges, a third straight edge, and a fourth curved edge. The two parallel straight edges can have equal lengths of approximately ten and three-eighths inches, the third straight edge can have a length of approximately four and one-quarter inches, and the curved edge can be arced with a radius of approximately fifteen inches.

The side intermediate members 208 and 210 can be substantially rectangular and joined to the base member along the parallel edges. Accordingly, a first set of parallel sides of the side intermediate members have a length of approximately ten and three-eighths inches. The second set of parallel sides have a length of approximately six inches. The center intermediate member 206 is substantially rectangular and joined to the base member along the third straight edge, and thus has a first set of parallel sides having a length of approximately four and one-quarter inches. The second set of parallel sides has a length of approximately six inches.

The side apex members 212 and 216 can be quadrilateral in shape, having respective first edges connected to one of the first set of parallel edges of their respective side members 208 and 210. Accordingly, the first edges of the side apex members 212 and 216 can be approximately ten and three-eighths inches in length. Respective second and third edges of the side apex members 212 and 216, which are adjacent to the first edge of the member, can have an equal length of approximately six inches. Respective fourth edges of the side apex members 212 and 216, which oppose the first edge of the member, can have a length of approximately nine and one-half inches. The center apex member 214 can be shaped as an isosceles triangle that is joined on a first edge to one of the first set of parallel sides of the center intermediate member 206 and on second and third edges to respective second edges of the side apex members 212 and 216. Accordingly, the two equal sides of center apex member 212, that is the second and third edges, can each have a length of approximately six inches, and the first edge can have a length of approximately four and one-quarter inches. A device, constructed with the measurements described for the illustrated implementation, can allows the omni-directional multi-polarized antenna assembly 202 to function as a directional antenna at a significantly higher gain for frequencies in a range around 2.4 GHz.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

Having described the invention, I claim:

1. An antenna assembly for receiving and transmitting radio frequency signals in a range around a characteristic wavelength comprising:

a first radiative element, having a first end and a second end and comprised of an electrically conductive material, the first end of the first radiative element electrically connected to an antenna feed at an apex point and at least a portion of the first radiative element being disposed outwardly away from the apex point at an acute angle relative to, and on a first side of, an imaginary plane intersecting the apex point;

a second radiative element, having a first end and a second end and comprised of an electrically conductive material, the first end of the second radiative element electrically connected to the antenna feed and the first radiative element at the apex point, at least a portion of the second radiative element extending in a direction substantially perpendicular to the imaginary plane, the second radiative element comprising:

a first linear segment extending upward from a first end at the apex point as to be substantially perpendicular to the imaginary plane;

a plurality of curvilinear segments extending from a second end of the first linear segment, each the first plurality of curvilinear segments having a first end connected to the second end of the first linear segment and extending away from the second end of the first linear segment in a direction substantially parallel to the imaginary plane; and a polygonal element connecting respective second ends of the plurality of curvilinear segments as to form a closed shape; and an electrically conductive ground reference.

2. The antenna assembly of claim 1, the second radiative element further comprising a plurality of linear elements having respective first ends that are connected to respective second ends of the plurality of curvilinear segments and extending upward from a second imaginary plane, defined by the polygonal element, at an acute angle relative to the second imaginary plane.

3. The antenna assembly of claim 1, the first linear segment having a length that is substantially equal to one-half of the characteristic wavelength.

4. A directional antenna assembly, comprising:

a conductive base member;

three intermediate members joined to the conductive base member at substantially right angles and extending on a first side of a plane defined by the conductive base member, two side intermediate members being joined to opposing edges of a center intermediate member, each conductive side intermediate member joined to the center intermediate member at an obtuse angle;

three apex members, each joined to an edge of one of the intermediate members at an obtuse angle relative to the intermediate member and extending away from the plane defined by the base member, the three apex members meeting at a common point; and the antenna assembly of claim 1, the antenna assembly being mounted to the conductive base member as to provide significant capacitive coupling between the electrically conductive ground reference and the conductive base member.

5. The directional antenna assembly of claim 4, wherein respective sizes and shapes of each of the conductive base member, the three intermediate members, and the three apex members are configured to focus electromagnetic radiation having frequencies in a range around 2.4 GHz to the antenna assembly.

6. The directional antenna assembly of claim 4, wherein each of the three intermediate members are substantially rectangular, and a center apex member of the three apex members is shaped as an isosceles triangle.

7. A directional antenna assembly, comprising:

a conductive base member;

three intermediate members joined to the conductive base member at substantially right angles and extending on a first side of a plane defined by the conductive base member, two side intermediate members being joined to opposing edges of a center intermediate member, each conductive side intermediate member joined to the center intermediate member at an obtuse angle;

three apex members, each joined to an edge of one of the intermediate members at an obtuse angle relative to the intermediate member and extending away from the plane defined by the base member, the three apex members meeting at a common point; and an antenna assembly mounted to the conductive base member as to provide significant capacitive coupling between a shield connected radiative element associated with the antenna assembly and the conductive base member.

8. The assembly of claim 7, the antenna assembly comprising:

a first radiative element, having a first end and a second end and comprised of an electrically conductive material, the first end of the first radiative element electrically connected to an antenna feed at an apex point and at least a portion of the first radiative element being disposed outwardly away from the apex point at an acute angle relative to, and on a first side of, an imaginary plane intersecting the apex point;

a second radiative element, having a first end and a second end and comprised of an electrically conductive material, the first end of the second radiative element electrically connected to the antenna feed and the first radiative element at the apex point, the second radiative element having a length greater than one-quarter of the characteristic wavelength; and an electrically conductive ground reference located to a second side of the imaginary plane.

9. The assembly of claim 7, wherein respective sizes and shapes of each of the conductive base member, the three intermediate members, and the three apex members are configured to focus electromagnetic radiation having frequencies in a range around 2.4 GHz to the antenna assembly.

10. The assembly of claim 7, wherein each of the three intermediate members are substantially rectangular, and a center apex member of the three apex members is shaped as an isosceles triangle.

11. An antenna assembly for receiving and transmitting radio frequency signals in a range around a characteristic wavelength comprising:

a plurality of radiative elements, each having a first end and a second end and comprised of an electrically conductive material, the first end of each radiative element being electrically connected to an antenna feed at an apex point such that each radiative element extends away from the apex on a first side of, an imaginary plane intersecting the apex point, and each radiative element comprising:

a first segment extending outwardly away from the apex point at an acute angle relative to the imaginary plane;

a second segment extending from the first segment in a direction that is substantially parallel to the imaginary plane, such that an angle formed by the first segment and the second segment is acute; and a third segment extending from the second segment in a direction that is substantially perpendicular to the imaginary plane, such that the angle between the second segment and the third segment is approximately ninety degrees; and an electrically conductive ground reference.

12. The antenna assembly of claim 11, the first and third segments each having a length that is substantially equal to one-quarter of the characteristic wavelength, and the second segment having a length that is substantially equal to one-eighth of the characteristic wavelength.

13. The antenna assembly of claim 12, wherein the characteristic wavelength is equal to approximately 12.5 centimeters.

14. The antenna assembly of claim 11, each radiative element further comprising:

a fourth segment extending from the third segment in a direction that is substantially parallel to the imaginary plane, such that an angle formed by the third segment and the fourth segment is substantially right; and a fifth linear segment extending from the third segment toward the center of the driven assembly, such that the angle between the fourth segment and the fifth segment is acute.

* * * * *